United States Patent [19]

Wildeman

[11] 3,954,074

[45] May 4, 1976

[54] TEXTILE

[76] Inventor: Arno Edgar Wildeman, Aurel House, Blueberry Road, Bowdon, Altrincham, Cheshire, England

[22] Filed: May 16, 1974

[21] Appl. No.: 470,650

[30] Foreign Application Priority Data

July 26, 1973 United Kingdom ..... 35639/73

[52] U.S. Cl. ..... 112/402; 112/420; 112/440; 66/192

[51] Int. Cl.[2] ..... D05B 93/00

[58] Field of Search ..... 112/402, 420, 421, 440; 161/403

[56] References Cited

UNITED STATES PATENTS

| | | | |
|---|---|---|---|
| 3,327,501 | 6/1967 | Bahlo | 66/202 X |
| 3,565,025 | 2/1971 | Owen | 112/402 X |
| 3,600,259 | 8/1971 | Smith et al. | 66/192 X |
| 3,616,124 | 10/1971 | Danhel et al. | 66/192 X |
| 3,649,428 | 3/1972 | Hughes | 66/192 X |
| 3,769,815 | 11/1973 | Ploch et al. | 66/202 X |

*Primary Examiner*—Alfred R. Guest

[57] ABSTRACT

Disclosed is a textile fabric having a backing material unsuitable for heat transfer printing and a surface material that is suitable for heat transfer printing.

14 Claims, 4 Drawing Figures

TEXTILE

Figure 1:
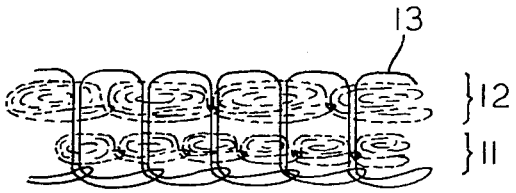

This invention relates to textile fabrics. Some textile fabrics, particularly so-called "flame proof" fabrics (that is to say, fabrics which have the property of resisting fire or flame) have disadvantages as regards colouring or patterning. It is particularly desirable that modern fabrics should be capable of heat transfer printing, in which a pattern or colour is transferred from a dye-bearing paper or other carrier (such as aluminium foil) on to the fabric by heat while the carrier and the fabric are in contact so that the dyestuffs sublime and pass over into the fabric.

Some materials are not capable of being heat transfer printed. Flame proof materials currently available, for example modified acrylic fibre, cannot be processed at temperatures above about 130°C, whereas heat transfer printing requires higher temperatures, up to 200°C or higher, in order to cause the dyestuffs properly to sublime. Some materials capable of being processed at the necessary high temperatures may not accept readily the dyestuffs used.

This invention comprises a textile fabric comprising essentially a backing material unsuitable for heat transfer printing and a surface material, such that the surface material can be heat transfer printed.

Where the backing material is unsuitable for heat transfer printing by virtue of its reaction to transfer printing temperatures (it may have a low melting point, or decompose) the surface material may be such (by virtue of its thermal conductivity, its specific heat, its thickness or a combination of such parameters) as to insulate the backing during printing.

A readily available textile fibre very suitable as a surface material is a polyester such as polyethylene terephthalate.

Not all fabric constructions lend themselves readily to heat transfer printing, but non-woven fabrics are usually very suitable, and especially fibre-knitted, stitch bonded or thermobonded fabrics.

A fabric according to the invention may comprise a backing fabric and a surface fabric, either or both of which may be non-woven, laminated together. The lamination may be effected by stitch bonding. For example a fibre knitted backing may be laminated to a fibre knitted surface by stitch bonding. Or an unconsolidated fibre web of suitable surface material may be stitch bonded to a backing, which may be another unconsolidated web or a fibre knitted fabric.

The fabric may be of homogeneous construction with different fibres in the surface and backing, such, for example, as may be formed by a fleece fabric making process from a single non-homogeneous fibre web such as may be produced by a cross folder from a carded fleece where a surface fibre has been fed to one side (or both sides) of the card, while the backing fibre is fed to the remainder of the card.

If both sides of the web have suitable surface material, both surfaces can be heat transfer printed. However, one side of the fabric only may be desired to be heat transfer printed, the other side being plain coloured, and the said other side may not in this case need to have a special surface. Such a material (especially if flame-proof) is suitable for use as curtains, where a fabric patterned on both sides is often lined on the window side with a plain fabric anyway.

The invention also comprises a method of making a heat transfer printable textile fabric comprising essentially a backing material unsuitable for heat transfer printing, comprising providing said fabric with a surface material such that the fabric can be heat transfer printed on said surface material.

A backing fabric may be provided with a surface fabric by a laminating process such as stitch bonding, or a backing material and a surface material may be fabricated together and may even be layers of the same fibre web, although composed of different fibres.

Figure 2:
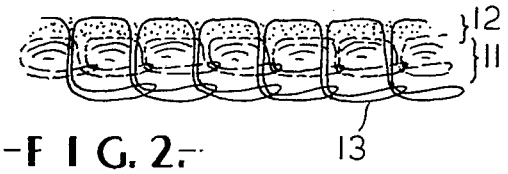
Figure 3:
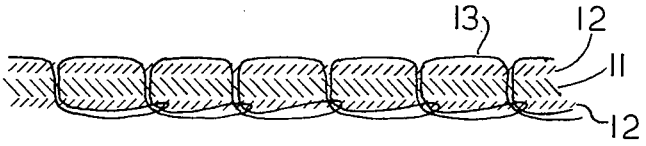
Figure 4:
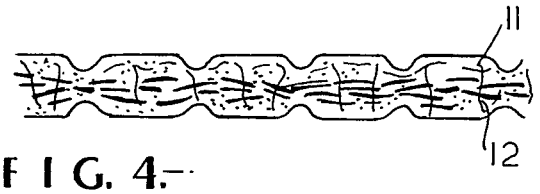

Embodiments of textile fabrics and methods of making them according to the invention will now be described with reference to the accompanying drawings in which:

FIG. 1 is a section through a first fabric,
FIG. 2 is a section through a second fabric,
FIG. 3 is a section through a third fabric, and
FIG. 4 is a section through a fourth fabric.

All the Figures illustrate textile fabrics comprising essentially a backing material 11 unsuitable for heat transfer printing and a surface material 12, such that the surface material 12 can be heat transfer printed.

FIG. 1 illustrates a fabric comprising a flame proof backing material 11 of modified acrylic fibres, which has been fibre knit from a carded and cross folded fibre web. The weight of the backing 11 is about 4 oz. per square yard. A fibre knit polyester fibre material 12 is stitch bonded, using polyester stitching yarn 13, to the backing material 11. The weight of the polyester material 12 is 2 to 2½ oz. per square yard.

Such a fabric can be heat transfer printed on the polyester side at 200°C or higher temperatures without affecting the heat sensitive acrylic backing 11, because the polyester surface layer effectively insulates the acrylic backing during the passage of the fabric through the heat transfer printing press.

Such a fabric is suitable for curtains. Only one side need be patterned, it being customary to line curtains with a backing of plain fabric in one of a few standard neutral colours which can be applied to the acrylic otherwise than by heat transfer printing. If, however, a fabric was required with a pattern on both sides, another surface material could be bonded in the same way as the polyester layer 12 and in the same operation, if desired, or by a different bonding process, to the other face of the backing 11.

The presence of the polyester in a minor proportion does not seriously affect the flame proof properties of the fabric. The relative weights of backing and surface materials can be adjusted depending on the fabric properties and the degree of non-inflammability required.

FIG. 2 illustrates a fabric which is essentially of a rayon fibre knit backing 11, for which dyestuffs commonly used in heat transfer printing have no affinity, and a polyester fibre web 12 stitch bonded thereto with polyester warp yarn 13. Such a fabric is suitable for clothing, the rayon being comfortable in wear and forming the skin side of the garment, the polyester being on the outside and carrying the transfer printed pattern.

FIG. 3 illustrates a fabric which is again essentially of a rayon backing 11 but which has both sides faced with polyester. This fabric is formed by stitch bonding with polyester warp yarn stitches a layered fibre web. The web is produced by cross folding a carded fleece which comprised polyester fibres at its edges, and rayon fibres in the middle. During cross folding, the polyester fibres at the edges of the carded web appear on the upper and under sides of the cross folded web while the rayon fibres are concealed in the interior. This fabric is suitable for tablecloths and other household fabrics such as curtains where a double sided fabric is required. A flameproof fibre can be used instead of the rayon.

FIG. 4 illustrates a thermo-bonded fabric formed again from a layered web. Polyester fibres 12 are on the surface, while a blend of melt fibres and structure fibers which cannot be heat transfer printed forms the backing 11. The web may be needled or fibre knitted in such manner as to cause some of the polyester fibres 12 to penetrate into and even through the backing 11 (thus, in fibre knitting, for example, the needles would penetrate from the backing 11 through the surface 12, bringing back surface fibre loops to the rear of the backing 11.) Then the web, now consolidated at least to some extent, is rolled under heat to cause the melt fibres in the backing to bond in the structure fibres and the fibres of the surface 12 which penetrate the backing 11. The thermobonding rollers may be smooth or patterned to apply a surface texture to the fabric on one or both sides.

I claim:

1. A heat transfer printed textile fabric comprising:

a backing material unsuitable for heat transfer printing; and a surface material that can be heat transfer printed, said fabric being heat transfer printed on said surface material and said backing material being substantially unaffected by the heat transfer printing.

2. A fabric according to claim 1, in which said backing material is of a type which is adversely affected by exposure to heat transfer printing temperatures, and said surface material is such as to insulate the backing material from such temperatures during the heat transfer printing.

3. A fabric according to claim 2, in which said backing material is a fire proof material.

4. A fabric according to claim 2, in which said backing material is formed of modified acrylic fibre.

5. A fabric according to claim 1, in which said surface material comprises a polyester.

6. A fabric according to claim 5, in which said polyester comprises polyethylene terephthalate.

7. A fabric according to claim 1, comprising a non-woven fibre fabric.

8. A fabric according to claim 7, comprising two non-woven fibre fabrics stitch bonded together.

9. A fabric according to claim 8, comprising a fibre knitted fabric.

10. A fabric according to claim 8, comprising two fibre knitted fabrics.

11. A fabric according to claim 1, comprising a backing fabric having an unconsolidated fibre web stitched thereto as the surface material.

12. A fabric according to claim 1, of homogeneous construction with different fibres in the surface and backing.

13. A fabric according to claim 12, comprising a fleece fabric of which the fleece composition is non-homogeneous.

14. A fabric according to claim 1, being a thermobonded fabric, the surface material being such as to insulate the backing material from thermobonding temperatures.

* * * * *